US007254966B2

(12) United States Patent
Kim et al.

(10) Patent No.: US 7,254,966 B2
(45) Date of Patent: Aug. 14, 2007

(54) WASHING MACHINE

(75) Inventors: Jong Seok Kim, Changwon-si (KR); Yang Hwan No, Changwon-si (KR); Han Ki Cho, Changwon-si (KR); Yeon Su Jung, Changwon-si (KR); Jung Hoon Kang, Changwon-si (KR); Myung Sik Park, Changwon-si (KR); Young Hoon Ha, Masan-si (KR)

(73) Assignee: LG Electronics Inc., Seoul (KR)

( * ) Notice: Subject to any disclaimer, the term of this patent is extended or adjusted under 35 U.S.C. 154(b) by 684 days.

(21) Appl. No.: 10/722,464

(22) Filed: Nov. 28, 2003

(65) Prior Publication Data

US 2004/0168483 A1 Sep. 2, 2004

(30) Foreign Application Priority Data

Nov. 28, 2002 (KR) ..... 10-2002-0074964

(51) Int. Cl.
*D06F 39/08* (2006.01)

(52) U.S. Cl. ..... 68/17 R; 68/207

(58) Field of Classification Search ..... 68/17 R, 68/207

See application file for complete search history.

(56) References Cited

U.S. PATENT DOCUMENTS 5,375,438 A * 12/1994 Babuin ..... 68/17 R
5,588,313 A * 12/1996 Hildebrand ..... 68/17 R
5,685,178 A * 11/1997 Ahn ..... 68/17 R
5,884,506 A * 3/1999 Blauert et al. ..... 68/17 R
6,044,510 A * 4/2000 Cho ..... 8/158
6,227,012 B1 * 5/2001 Borroni et al. ..... 68/17 R
7,093,467 B2 * 8/2006 Kim et al. ..... 68/17 R

FOREIGN PATENT DOCUMENTS

DE 90 18 154 * 1/1997
JP 11-42393 * 2/1999
JP 2000-342894 * 12/2000

OTHER PUBLICATIONS

European Patent Office 0 244 900 Nov. 1987.*

* cited by examiner

*Primary Examiner*—Frankie L. Stinson
(74) *Attorney, Agent, or Firm*—Birch, Stewart, Kolasch & Birch, LLP

(57) ABSTRACT

Disclosed is a detergent storing assembly and washing machine using the same, by which a lid part and a detergent box constructing the detergent storing assembly are correctly assembled to each other. The present invention includes a tub having an open front side to hold water and detergent, a drum rotatably installed in the tub to hold laundry, a motor rotating the drum, a cabinet having the tub and the motor inside, and a detergent storing assembly at the cabinet to provide the detergent to detergent to the tub. And, the detergent storing assembly includes a detergent box having an open topside to store the detergent and to provide the detergent to the tub for washing, a lid part fixed to the topside of the detergent box to open/close, and an incorrect-assembling preventing means for leading the lid part to a correct position for a reciprocal assembling of the lid part and the detergent box.

18 Claims, 4 Drawing Sheets

WASHING MACHINE

This application claims the benefit of Korean Application(s) No. 10-2002-0074964 filed on Nov. 28, 2002, which is/are hereby incorporated by reference.

BACKGROUND OF THE INVENTION

1. Field of the Invention

The present invention relates to a washing machine, and more particularly, to a washing machine having a means for preventing a lid frame having a lid from being incorrectly assembled to a detergent box.

2. Discussion of the Related Art

Generally, water and detergent are held in a tub of a drum type washing machine and a laundry if put in a drum inside the tub. The drum is then rotated to perform washing, rinsing, and dewatering.

The general drum type washing machine consists of a tub having an open front side to hold water and detergent, a drum rotatably provided in the tub to hold laundry, a motor rotating the drum, a cabinet holding the tub and the motor inside, and a detergent box in the cabinet to provide the detergent to the tub.

A user has difficulty in putting an appropriate amount of detergent in the drum directly. Moreover, if the detergent is directly put in the drum, color of the laundry may be changeable. Hence, the detergent storing assembly is separately installed in an upper part of the cabinet to allow the detergent to flow in the tub together with the supplied water.

The detergent storing assembly consists of a detergent box holding a detergent to provide to a tub in washing, a lid frame fixed to an upper rim of the detergent box to have an opening at an entrance for inputting the detergent, and a lid hinge-coupled to the lid frame to open/close a topside of the detergent box.

The detergent box is installed at a top plate, on which a control panel for controlling a washing machine is installed, forming a topside of a cabinet of the washing machine and has a plurality of detergent storing parts to separately store detergent powder, fiber softener, and bleaching agent.

Specifically, the detergent box is installed in a loading hole formed at the top plate. For this, the detergent box has hooks formed at front and rear ends. Also, hook holes are formed on an inner wall of the loading holes to correspond to the hooks.

The lid frame connected to the lid is fixed to the above-constructed detergent box.

The lid frame is assembled to the detergent box in the following manner. First of all, fitting protrusions protruding upward from both upper sides of the front and rear ends of the detergent box are fitted to coupling protrusions protruding downward from a bottom of the lid frame, respectively. Also, the lid frame is then fixed to the detergent box using screws.

The lid frame assembled to the detergent box is loaded on the rim of the loading hole at the top plate.

However, in the above-constructed detergent storing assembly of the drum type washing machine, a plurality of the fitting protrusions formed at the upper front and rear ends of the detergent box are formed alike, as well as a plurality of the coupling protrusions formed at the bottom of the lid frame are formed alike. Hence, the lid frame may be turned by 180° to be incorrectly assembled to the detergent box.

To overcome such a problem, development of a washing machine having a structure enabling to prevent the incorrect assembly between the lid frame and the detergent box is needed.

SUMMARY OF THE INVENTION

Accordingly, the present invention is directed to a detergent storing assembly and washing machine using the same that substantially obviates one or more of the problems due to limitations and disadvantages of the related art.

An object of the present invention, which has been devised to solve the foregoing problem, lies in providing a detergent storing assembly and washing machine using the same, by which a lid part and a detergent box constructing the detergent storing assembly are correctly assembled to each other.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a washing machine including a tub having an open front side to hold water and detergent, a drum rotatably installed in the tub to hold laundry, a motor rotating the drum, a cabinet having the tub and the motor inside, and a detergent storing assembly at the cabinet to provide the detergent to detergent to the tub, the detergent storing assembly including a detergent box having an open topside to store the detergent and to provide the detergent to the tub for washing, a lid part fixed to the topside of the detergent box to open/close, and an incorrect-assembling preventing means for leading the lid part to a correct position for a reciprocal assembling of the lid part and the detergent box.

The incorrect-assembling preventing means includes at least one guide protrusion protruding from a bottom of the lid part to interrupt the reciprocal assembling in case that the lid part is incorrectly disposed over the detergent box and at least one guide groove formed at a portion of the detergent box corresponding to the guide protrusion to have the at least one guide protrusion inserted therein.

Moreover, the incorrect-assembling preventing means may include at least one guide protrusion protruding from the topside of the detergent box to interrupt the reciprocal assembling in case that the lid part is incorrectly disposed over the detergent box and at least one guide groove formed at a bottom of the lid part corresponding to the guide protrusion to have the at least one guide protrusion inserted therein.

The lid part includes a lid frame fixed to the detergent box and having an opening at a center to put the detergent in the detergent box and a revolvable lid installed at one side of the lid frame to open/close the topside of the detergent box.

The lid frame is fixed to the detergent box by at least one screw coupled from a topside of the lid frame.

The lid frame includes coupling protrusions protruding from a bottom toward the detergent box to have cavities in an axial direction, respectively and wherein the detergent box comprises insertion protrusions protruding from a rim of the topside of the detergent box to be inserted in the cavities of the coupling protrusions and having screw threads inside to be coupled to the screws, respectively.

The lid frame includes a rectangular frame having a rectangular opening at a central part.

The coupling protrusions are formed at bottoms of a pair of long or short sides of the lid frame.

In this case, the incorrect-assembling preventing means includes guide grooves formed at inner walls of the cavities of the coupling protrusions at a pair of the long or short sides in different directions, respectively to interrupt the reciprocal assembling in case that the lid part is incorrectly disposed over the detergent box and guide protrusions protruding from outsides of the insertion protrusions in directions corresponding to the guide grooves, respectively.

Therefore, the incorrect-assembling preventing means enables to assemble the lid part to the detergent box correctly.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 1:
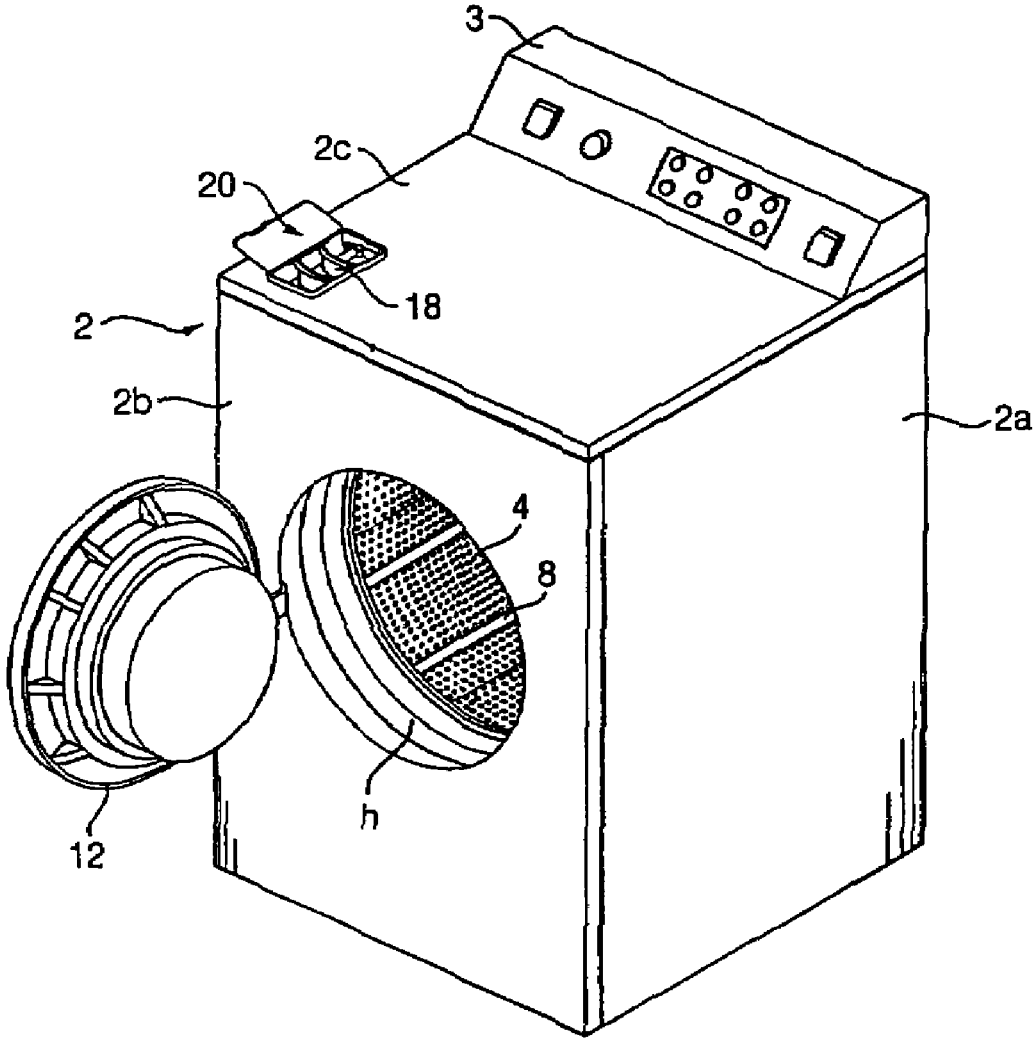
FIG. 1 is a perspective view of a washing machine according to the present invention.
Figure 2:
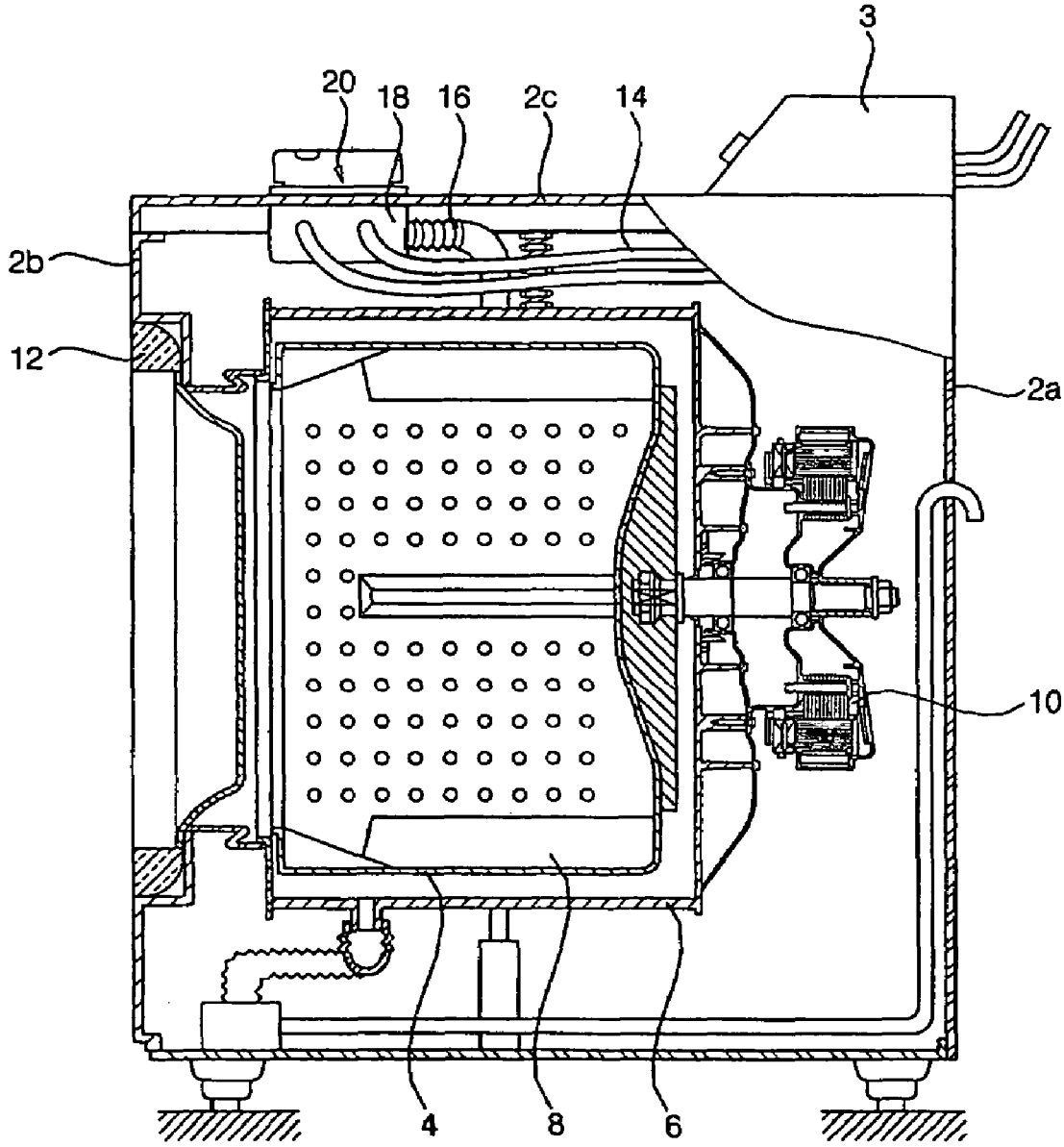
FIG. 2 is a cross-sectional view of a washing machine according to the present invention.
Figure 3:
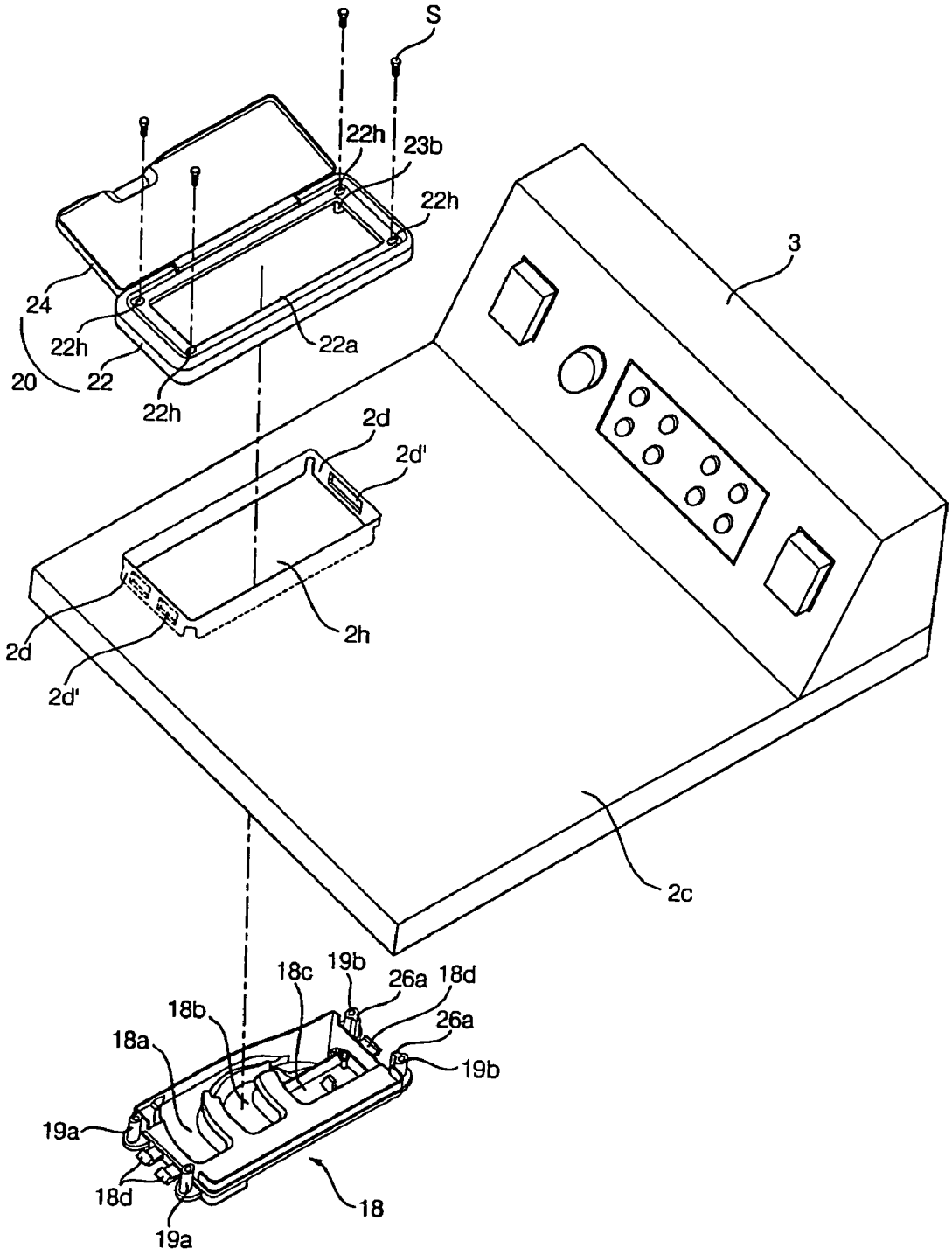
FIG. 3 is a perspective view of a detergent storing assembly of a washing machine according to the present invention.
Figure 4:
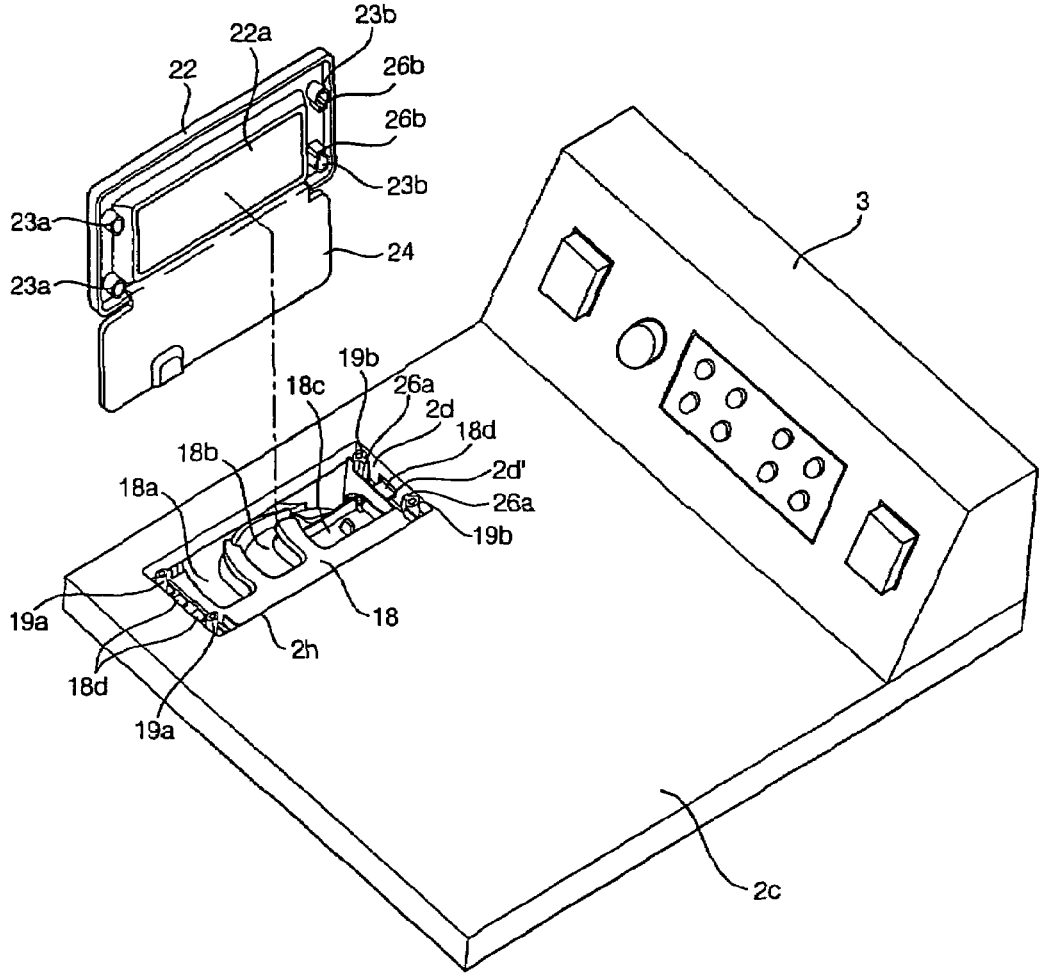
FIG. 4 is a perspective view of a detergent box installed at a cabinet of a washing machine according to the present invention.

FIG. 1 is a perspective view of a washing machine according to the present invention, FIG. 2 is a cross-sectional view of a washing machine according to the present invention, FIG. 3 is a perspective view of a detergent storing assembly of a washing machine according to the present invention, and FIG. 4 is a perspective view of a detergent box installed at a cabinet of a washing machine according to the present invention.

Referring to FIG. 1, a washing machine includes a cabinet 2 forming an exterior, an outer tub 6 provided inside the cabinet 2 to hold water and detergent, an inner tub 4 rotatably installed inside the outer tub 2 to hold laundry, and a motor 10 provided in rear of the outer tub 6 to rotate the drum 4.

A plurality of lifters 8 are installed on an inner circumference of the inner tub 4 to lift the laundry to a predetermined height when the drum 4 rotates.

The inner tub 4 holds the laundry, water, and detergent and constructs a washing tub together with the outer tub 6.

The cabinet 2 includes a cabinet body 2*a* having an open top and an open front side, a cabinet cover 2*b* coupled to the front side of the cabinet body 2*a* and having an entrance h via which the laundry is put in the drum 4, and a top plate 2*c* coupled to the open top of the cabinet body 2*a*. Also, a door 12 is installed at the cabinet cover 2*b* to open/close the entrance h.

A control panel 3, in which electronic parts for controlling an operation of the washing machine are installed, is installed on a rear part of the top plate 2*c*.

Also, a detergent storing assembly 20, which stores detergent inside so that water supplied via an inlet hose 14 flows in the outer tub 6 together with the detergent, is installed in a loading hole 2*h* formed rectangular in one side of the top plate 2*c*.

Referring to FIG. 3 and FIG. 4, the detergent storing assembly 20 includes a detergent box 18 having an open topside and partitioned into a plurality of detergent storing parts 18*a*, 18*b*, and 18*c* to separately store detergent powder, fiber softener, and bleaching agent and a lid part 20 coupled to the open topside of the detergent box 18 to open/close.

The lid part 20 includes a rectangular lid frame 22 having an opening 22*a* long enough to let the various detergents put in the detergent storing parts 18*a*, 18*b*, and 18*c* and a lid 24 hinge-coupled to the lid frame 22.

The detergent box 18 is installed to be connected to the inlet hose 14 and supplies the detergent to the outer tub 6 via an inlet bellows 16 installed over the outer tub 6.

Specifically, the detergent box 18 has hooks 18*d* formed at front and rear ends to be assembled to the loading hole 2*h*. And, hook holes 2*d'* are formed on an inner wall of a rim 2*d* of the loading hole 2*h* to correspond to the hooks 18*d*.

And, the lid frame 22 is assembled to the topside of the detergent box 18 by screws S.

For this, the lid frame 22 includes coupling protrusions 23*a* and 23*b* protruding from a bottom toward the detergent box 18 to have cavities in an axial direction, respectively. And, the detergent box 18 includes insertion protrusions 19*a* and 19*b* protruding from a top of a rim to be inserted in the cavities of the coupling protrusions 23*a* and 23*b* and having screw threads inside to be coupled to the screws S, respectively.

The detergent storing assembly according to the present invention further includes an incorrect-assembling preventing means 19*b* and 23*b* provided between the detergent box 18 and the lid frame 22 to enable the lid frame 22 to be correctly coupled to the detergent box 18.

The incorrect-assembling preventing means includes guide grooves 26*b* formed in different directions at inner walls of the cavities of the coupling protrusions, respectively and guide protrusions 26*a* protruding from an outside of the insertion protrusions in directions corresponding to the guide grooves 26*b*, respectively.

In the present invention, the guide protrusions 26*a* protrude from outsides of a pair of the insertion protrusions 19*b* to confront each other, respectively, and the guide grooves 26*b* are grooves recessed at inner walls of a pair of the coupling protrusions 23*b* to have the guide protrusions 26*a* inserted therein, respectively when the lid frame 22 is assembled to the detergent box 18.

The guide groove 26*b* may be formed at one of a pair of the coupling protrusions 23*b* and the guide protrusion 26*a* may be selectively formed at one of a pair of the insertion protrusions 19*b* as well.

Of course, the incorrect-assembling preventing means 19*b* and 23*b* may include at least one guide protrusion protruding from the rib part, and more specifically, from a bottom of the lid frame 22 and at least one guide groove formed at a portion of the detergent box 18 corresponding to the guide protrusion to have the guide protrusion inserted therein.

Moreover, the incorrect-assembling preventing means 19*b* and 23*b* may include at least one guide protrusion protruding from the topside of the detergent box 18 and at least one guide groove formed at a portion of the bottom of the lid part corresponding to the guide protrusion to have the guide protrusion inserted therein.

Namely, if the lid frame 22 is incorrectly aligned over the detergent box 18 such that the front or rear end of the lid frame 22 is horizontally turned by 180°, the guide grooves 26*b* are disposed over the front end insertion protrusions 26*a* so that the lid frame 22 is unable to be assembled to the detergent box 18.

An assembling process of the above-constructed detergent box 18 and lid part 20 is explained as follows.

First of all, the detergent box 18 is coupled to the inside of the loading hole 2*h* by the hooks 18*d* and the hook holes 2*d'*.

And, the lid frame 22 connected to the lid 24 is coupled to the topside of the detergent box 18 by the screws S to enable to open/close the topside of the detergent box 18.

In this case, the insertion protrusions 19*a* and 19*b* formed at the topside front and rear ends of the detergent box 18 are inserted in the coupling protrusions 23*a* and 23*b* formed at the bottom front and rear ends of the lid frame 22, and the guide protrusion 26*a* is inserted in the guide grove 26*b*. Once the screws S are coupled to the coupling holes 22*h* of the lid frame 22, the detergent box 18 and the lid frame 22 are fixed to each other.

The washing machine having the above-constructed detergent storing assembly according to the present invention has the following advantages or effects.

First of all, when the lid frame is mounted on the detergent box to be assembled thereto, the incorrect-assembling preventing means prevents the lid frame from being incorrectly assembled to the detergent box. Therefore, the present invention enhances assembling efficiency, thereby reducing assembling time and enhancing productivity.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A detergent storing assembly of a washing machine, the detergent storing assembly comprising:

a detergent box provided to a cabinet of the washing machine to hold detergent and to supply the detergent to a tub for washing;

a lid part fixed to a topside of the detergent box to open/close; and an incorrect-assembling preventing means for leading the lid part to a correct position for a reciprocal assembling of the lid part and the detergent box said incorrect-assembling preventing means comprising:

at least one guide protrusion protruding from a bottom of the lid part to interrupt the reciprocal assembling in the case that the lid part is incorrectly disposed over the detergent box, and at least one guide groove formed at a portion of the detergent box corresponding to the guide protrusion to accommodate the at least one guide protrusion inserted therein.

2. A washing machine comprising:

a tub having an open front side to hold water and detergent;

a drum rotatably installed in the tub to hold laundry;

a motor rotating the drum;

a cabinet having the tub and the motor inside; and a detergent storing assembly at the cabinet to provide the detergent to detergent to the tub, the detergent storing assembly comprising:

a detergent box having an open topside to store the detergent and to provide the detergent to the tub for washing;

a lid part fixed to the topside of the detergent box to open/close; and an incorrect-assembling preventing means for leading the lid part to a correct position for a reciprocal assembling of the lid part and the detergent box, said incorrect-assembling preventing means comprising:

at least one guide protrusion protruding from a bottom of the lid part to interrupt the reciprocal assembling in the case that the lid part is incorrectly disposed over the detergent box, and at least one guide groove formed at a portion of the detergent box corresponding to the guide protrusion to accommodate the at least one guide protrusion inserted therein.

3. A detergent storing assembly of a washing machine, the detergent storing assembly comprising:

a detergent box provided to a cabinet of the washing machine to hold detergent and to supply the detergent to a tub for washing;

a lid part fixed to a topside of the detergent box to open/close; and an incorrect-assembling preventing means for leading the lid part to a correct position for a reciprocal assembling of the lid part and the detergent box, said incorrect-assembling preventing means comprising:

at least one guide protrusion protruding from the topside of the detergent box to interrupt the reciprocal assembling in case that the lid part is incorrectly disposed over the detergent box, and at least one guide groove formed at a bottom of the lid part corresponding to the guide protrusion to have the at least one guide protrusion inserted therein.

4. A detergent storing assembly of a washing machine, the detergent storing assembly comprising:

a detergent box provided to a cabinet of the washing machine to hold detergent and to supply the detergent to a tub for washing;

a lid part fixed to a topside of the detergent box to open/close; and an incorrect-assembling preventing means for leading the lid part to a correct position for a reciprocal assembling of the lid part and the detergent box wherein the lid part comprises;

a lid frame fixed to the detergent box and having an opening at a center to put the detergent in the detergent box, and a revolvable lid installed at one side of the lid frame to open/close the topside of the detergent box.

5. The detergent storing assembly as claimed in claim 4, wherein the lid frame is fixed to the detergent box by at least one screw coupled from a topside of the lid frame.

6. The detergent storing assembly as claimed in claim 5, wherein the lid frame comprises coupling protrusions protruding from a bottom toward the detergent box to have cavities in an axial direction, respectively and wherein the detergent box comprises insertion protrusions protruding from a rim of the topside of the detergent box to be inserted in the cavities of the coupling protrusions and having screw threads inside to be coupled to the screws, respectively.

7. The detergent storing assembly as claimed in claim 6, wherein the lid frame comprises a rectangular frame having a rectangular opening at a central part.

8. The detergent storing assembly as claimed in claim 7, wherein the incorrect-assembling preventing means comprises;

guide grooves recessed into inner walls of the cavities of the coupling protrusions in different directions, respectively to interrupt the reciprocal assembling in case that the lid part is incorrectly disposed over the detergent box, and guide protrusions protruding from outsides of the insertion protrusions in directions corresponding to the guide grooves, respectively.

9. The detergent storing assembly as claimed in claim 4, wherein the incorrect-assembling preventing means comprises;

at least one guide protrusion protruding from a bottom of the lid frame to interrupt the reciprocal assembling in case that the lid part is incorrectly disposed over the detergent box, and at least one guide groove formed at a rim of the detergent box corresponding to the guide protrusion to have the at least one guide protrusion inserted therein.

10. The detergent storing assembly as claimed in claim 4, wherein the incorrect-assembling preventing means comprises;

at least one guide protrusion protruding from a rim of the detergent box to interrupt the reciprocal assembling in case that the lid part is incorrectly disposed over the detergent box, and at least one guide groove formed at a bottom of the lid part corresponding to the guide protrusion to have the at least one guide protrusion inserted therein.

11. The detergent storing assembly as claimed in claim 4, wherein the lid frame comprises a rectangular frame having a rectangular opening at a central part.

12. A washing machine comprising:

a tub having an open front side to hold water and detergent;

a drum rotatably installed in the tub to hold laundry;

a motor rotating the drum;

a cabinet having the tub and the motor inside; and a detergent storing assembly at the cabinet to provide the detergent to detergent to the tub, the detergent storing assembly comprising:

a detergent box having an open topside to store the detergent and to provide the detergent to the tub for washing;

a lid part fixed to the topside of the detergent box to open/close; and an incorrect-assembling preventing means for leading the lid part to a correct position for a reciprocal assembling of the lid part and the detergent box said incorrect-assembling preventing means comprising:

at least one guide protrusion protruding from the topside of the detergent box to interrupt the reciprocal assembling in case that the lid part is incorrectly disposed over the detergent box, and at least one guide groove formed at a bottom of the lid part corresponding to the guide protrusion to have the at least one guide protrusion inserted therein.

13. A washing machine comprising:

a tub having an open front side to hold water and detergent;

a drum rotatably installed in the tub to hold laundry;

a motor rotating the drum;

a cabinet having the tub and the motor inside; and a detergent storing assembly at the cabinet to provide the detergent to detergent to the tub, the detergent storing assembly comprising:

a detergent box having an open topside to store the detergent and to provide the detergent to the tub for washing;

a lid part fixed to the topside of the detergent box to open/close; and an incorrect-assembling preventing means for leading the lid part to a correct position for a reciprocal assembling of the lid part and the detergent box wherein the lid part comprises;

a lid frame fixed to the detergent box and having an opening at a center to put the detergent in the detergent box, and a revolvable lid installed at one side of the lid frame to open/close the topside of the detergent box.

14. The washing machine as claimed in claim 13, wherein the lid frame is fixed to the detergent box by at least one screw coupled from a topside of the lid frame.

15. The washing machine as claimed in claim 14, wherein the lid frame comprises coupling protrusions protruding from a bottom toward the detergent box to have cavities in an axial direction, respectively and wherein the detergent box comprises insertion protrusions protruding from a rim of the topside of the detergent box to be inserted in the cavities of the coupling protrusions and having screw threads inside to be coupled to the screws, respectively.

16. The washing machine as claimed in claim 15, wherein the lid frame comprises a rectangular frame having a rectangular opening at a central part.

17. The washing machine as claimed in claim 16, wherein the coupling protrusions are formed at bottoms of a pair of long or short sides of the lid frame.

18. The washing machine as claimed in claim 17, wherein the incorrect-assembling preventing means comprises;

guide grooves formed at inner walls of the cavities of the coupling protrusions at a pair of the long or short sides in different directions, respectively to interrupt the reciprocal assembling in case that the lid part is incorrectly disposed over the detergent box, and guide protrusions protruding from outsides of the insertion protrusions in directions corresponding to the guide grooves, respectively.

* * * * *